US005623714A

United States Patent [19]

Thompson et al.

[11] Patent Number: 5,623,714

[45] Date of Patent: Apr. 22, 1997

[54] AUTOMATIC EXPOSURE CORRECTION USING CURRENT SENSING TECHNOLOGY

[75] Inventors: David M. Thompson, Fairport; Carol J. Panepinto, Rochester; Edward C. Savage, Webster, all of N.Y.

[73] Assignee: Xerox Corporation, Stamford, Conn.

[21] Appl. No.: 344,297

[22] Filed: Nov. 23, 1994

[51] Int. Cl.[6] ..... G03G 15/043

[52] U.S. Cl. ..... 399/51

[58] Field of Search ..... 355/208, 246, 355/210, 211, 204; 399/51

[56] References Cited

U.S. PATENT DOCUMENTS

| | | | |
|---|---|---|---|
| 4,348,099 | 9/1982 | Fantozzi . | |
| 4,693,592 | 9/1987 | Kurpan | 355/208 |
| 4,982,232 | 1/1991 | Naito | 355/208 |
| 5,087,942 | 2/1992 | Rushing | 355/214 |
| 5,150,155 | 9/1992 | Rushing | 355/208 |
| 5,315,351 | 5/1994 | Matsushiro et al. | 355/246 |
| 5,351,107 | 9/1994 | Nakano et al. | 355/208 |
| 5,416,563 | 5/1995 | Magde, Jr. | 355/208 |
| 5,416,564 | 5/1995 | Thompson et al. | 355/208 |
| 5,504,557 | 4/1996 | Morita | 355/208 |

*Primary Examiner*—William J. Royer
*Attorney, Agent, or Firm*—Ronald F. Chapuran

[57] ABSTRACT

An image processing apparatus includes a corona device with a charging grid for charging a photoreceptor to voltage levels, an exposure device for projecting an image onto the photoreceptor, a developer for applying toner to the photoreceptor, and a sensor for providing a signal in relation to current flow between the photoreceptor and the developer. An exposure device control adjusts the exposure device by setting the exposure device to an intensity level of approximately 50%. A photodetector sensor provides signals to the exposure device control in relation to the 50% intensity level in response to developing the predetermined test patches on the photoreceptor and the exposure device control adjusts the exposure device in response to the photodetector sensor signals without the use of test patches to an intensity level of approximately 100%.

22 Claims, 9 Drawing Sheets

AUTOMATIC EXPOSURE CORRECTION USING CURRENT SENSING TECHNOLOGY

BACKGROUND OF THE INVENTION

The invention relates to xerographic process control, and more particularly, to using current sensing technology for automatic exposure correction to compensate for loss of exposure due to contamination of the optical system.

Xerographic control is well known in the prior art. The art is replete with various sensors and systems for charging control, for exposure and illumination control, for developer control, and for measuring toner concentration and adjusting toner dispensers. For example, U.S. Pat. No. 4,348,099 discloses the uses of test patches, an infrared densitometer, and an electrometer for charge, illumination, toner dispenser, and developer bias control. It is also known in prior art machines to automatically compensate for optics contamination by periodically adjusting exposure components.

One difficulty, however, with the prior art systems, has been that the periodic adjustments for contamination usually are part of an overall system reset that is relatively time consuming. For example, during the exposure adjustment to compensate for contamination, usually there is an exposure adjustment for best background suppression and for low density line development. In addition, there is an exposure reset to compensate for changes in dark development potential due to photoreceptor dark decay variation as the photoreceptor ages. During this time, toner test patches fill up the cleaning sump and belt cycles are run without copies being generated. This is an inefficient use of the machine.

It is an object, therefore, of the present invention to provide new and improved automatic exposure reset for contamination compensation that is not part of a comprehensive xerographic system set up. Another object of the present invention is to avoid inefficient component usage in order to automatically reset the exposure system to compensate for optics contamination. Another object of the present invention is to automatically determine illumination levels without the use of toner patches that burden the machine cleaning system. Other objects and advantages of the present invention will become apparent as the following description proceeds, and the features characterizing the invention will be pointed out with particularity in the claims annexed to and forming a part of this specification.

SUMMARY OF THE INVENTION

An image processing apparatus has a corona or other charging device for charging a photoreceptor to provide reference test patches including a partial reflectance reference and an exposure device for projecting an image of an object along an optical path onto the photoreceptor. A developer applies toner to the photoreceptor and a sensor provides a signal in relation to current flow between the photoreceptor and the developer. Based upon feedback from the current flow sensor, the exposure device is set to obtain approximately 300 volts on the photoreceptor corresponding to approximately 50% reflectance from a white reference patch. Next, an optical sensor value is obtained of the exposure device output at 50% reflectance, which is stored in non-volatile memory. Using this stored value, an exposure device control can then adjust the exposure device from 50% reflectance to 100% reflectance for full intensity at given intervals. The exposure control does this by increasing the exposure device output until the output is approximately double the 50% reflectance sensor output without the use of additional test patch development. This provides an approximately 100% reflectance from a white reference and is used to adjust the exposure device.

For better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
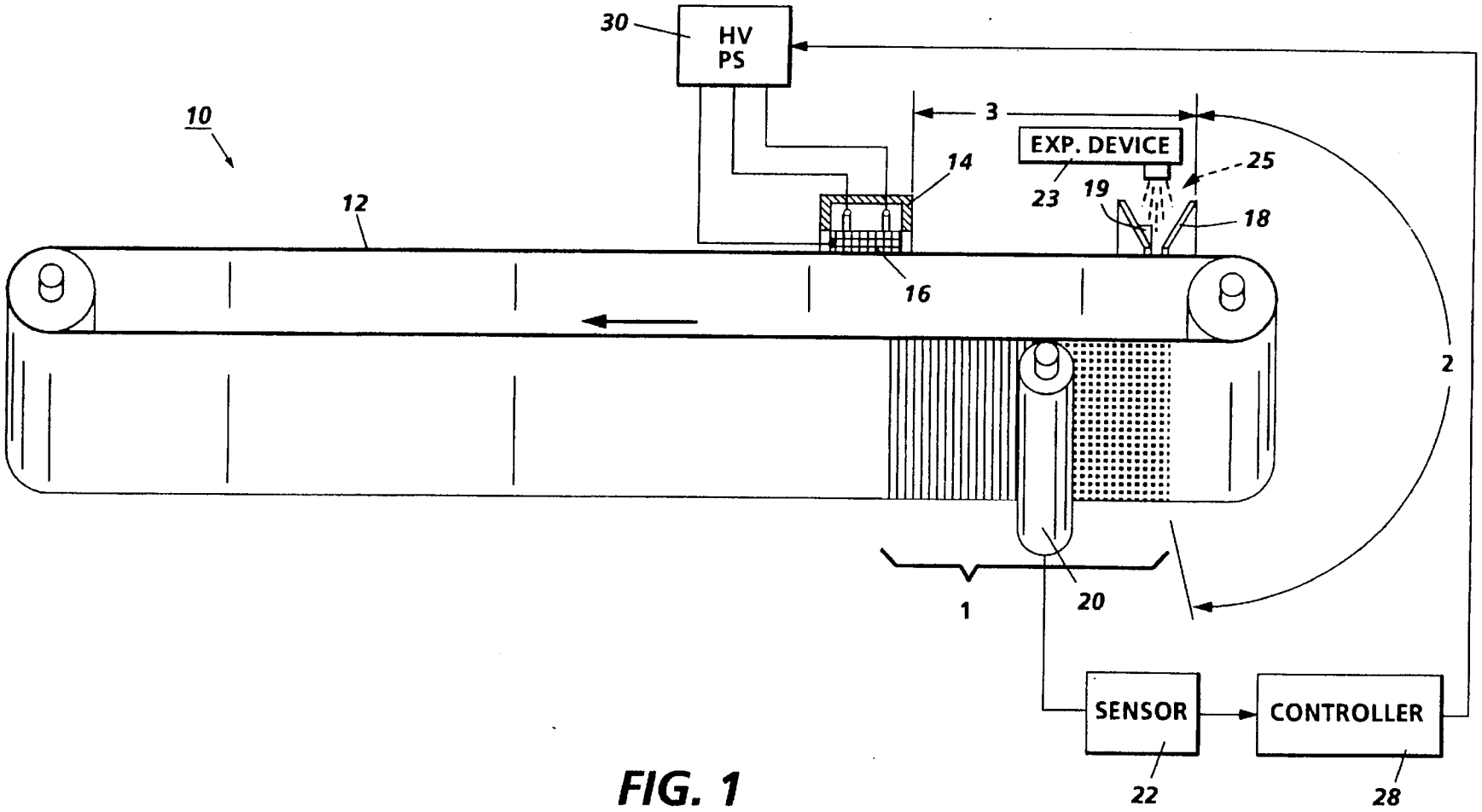
FIG. 1 is an elevational view depicting portions of a typical electrostatic system incorporating the present invention.

Referring to FIG. 1, there is generally shown at 10 portions of an exemplary printing or reproduction machine in which the features of the present invention may be incorporated. It should be understood that FIG. 1 could be any suitable machine having various well known machine components including a photoconductive surface 12 rotated through various stations. For example, a charging station employs a corona generating device such as a scorotron 14 having a charging electrode and grid 16 positioned adjacent the photoconductive surface 12 to charge the photoconductive surface to a relatively high uniform potential.

The charged portion of photoconductive surface 12 is then rotated to an exposure station 18 for producing a light image of an original document placed on a not shown platen. In particular, a lamp or exposure device 23 illuminates incremental portions of the original document disposed on the platen in moving across the platen. The light rays reflected from the original document are projected along on optical path onto the photoconductive surface. Optical sensor or photodetector 19 is positioned downstream in the optical path 25 to obtain output signals corresponding to levels of exposure.

As the surface 12 continues to rotate, the recorded electrostatic latent image is advanced to a development station including a not shown housing containing a supply of developer mix and a developer roller 20. The developer roller 20 is typically a magnetic (mag) brush roller and generally includes a stationary magnetic member having a non-magnetic, rotatable tubular member positioned telescopically over the stationary member. The developer roller 20 advances the developer mix into contact with the electrostatic latent image on the photo conductive surface. As successive electrostatic latent images are developed, the toner particles within the developer mix are depleted. Additional toner particles are stored in a suitable toner cartridge and dispensed as needed.

Other not shown but well known xerographic steps complete the process. For example, after the toner powder image has been developed on a photoconductive surface, often a corona generating device applies a charge to pre-condition the toner powder image for transfer. A sheet of support material is advanced by suitable sheet feeding apparatus to a transfer station including a corona generating device for charging the underside of the sheet of support material to a level sufficient to attract the toner powder image from a photoconductive surface.

After transfer of the toner powder image to the sheet of support material, a suitable stripping system separates the sheet from the photoconductive surface and advances it to a not shown fusing station. The fusing station includes a heated fuser roll in contact with a resilient backup roll. The sheet of support material advances between the fuser roll and the backup roll with the toner powder image contacting the fuser roll. After the toner powder image has been permanently fused to the copy sheet, the copy sheets are advanced by a series of rollers to suitable output trays.

To set the photoreceptor DDP or dark development potential to the right starting level at power-up or at predetermined copy intervals would typically require a sensor such as an ESV (Electro-Static Voltmeter) to measure the photoreceptor voltage directly or an IRD (Infrared Densitometer) to measure toner development and then adjust the Scorotron Grid to obtain the required DDP. These sensors add prohibitive cost to the product.

In accordance with the present invention, there is provided a low cost method of using CSDC (current sensing developability control) circuitry for automatic exposure correction to compensate for loss of exposure due to contamination of the optical system by estimating full exposure intensity from an approximately 50% exposure intensity level.

In general, CSDC technology provides signals from the current flow induced by toner leaving the developer housing during copy image or toner patch development. In other words, as toner leaves the developer mag brush or magnetic roll and is attracted to the photoreceptor, there is a measurable current flow. The more charge on the photoreceptor, the more toner that leaves the magnetic roll. By development of selected toner patches, the amount of voltage on the photoreceptor can be determined.

In particular, CSDC circuitry relies on the functional relationship between toner tribo charge level Q (coulombs/gram) and the rate of toner transfer to the photoreceptor M (grams/second). That is, $^{I}$BIAS (coulombs/second=Q×M. This relationship is linear and the slope is established by the system geometry. The current, $^{I}$BIAS, is substantially independent of toner concentration and developer housing sump tribo. The current is a function of the percent area coverage and surface potential of the latent image on, the photoreceptor. By fixing area coverage at 100 percent, $^{I}$BIAS now only depends on the potential of the latent image on the photoreceptor.

The latent image potential establishes the toner development field. The development field is functionally related to the latent image potential minus the developer housing bias voltage. ($^{V}$DEV=$^{V}$P/R−$^{V}$BIAS). Toner development area coverage is fixed and $^{V}$BIAS is fixed. This makes $^{V}$DEV proportional to photoreceptor latent image $^{V}$P/R. Therefore, as $^{V}$P/R is increased above $^{V}$BIAS, BIAS current $^{I}$BIAS increases in proportion. $^{I}$BIAS is measured as the response to determine the voltage $^{V}$P/R. This knowledge is applied as follows: By measuring $^{I}$BIAS (developer bias current during toner development), $^{V}$DEV can be determined from the $^{V}$DEV−$^{I}$BIAS relationship.

Figure 2:
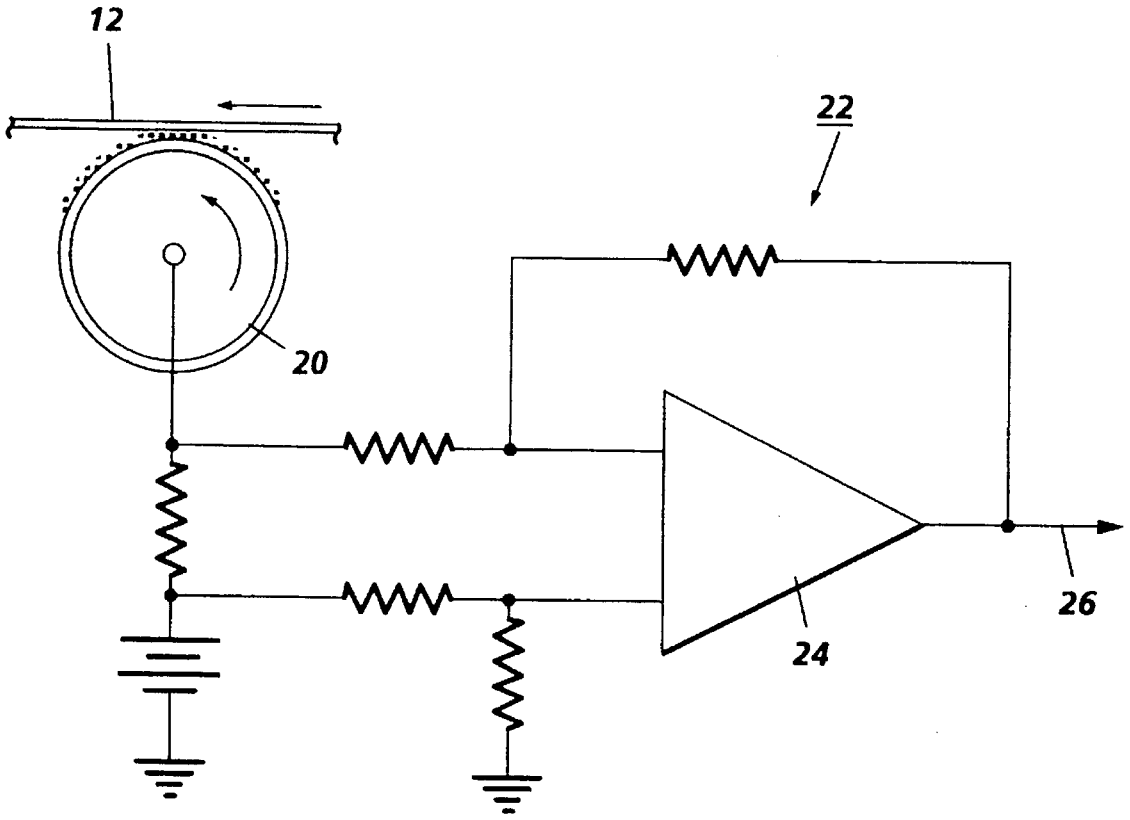
FIG. 2 is a circuit diagram in accordance with the present invention depicting a typical current sensor shown in FIG. 1.

With reference to FIG. 2, there is generally disclosed a typical current sensing device 22 in relation to photoconductive surface 12 showing a negative charge disposed opposite a developer mag brush supporting positively charged toner particles. Current sensing devices are known in the prior art. One embodiment includes Op Amp 24 with suitable resistive elements providing an output signal at 26. The induced current flow from the charge transfer from the positive charged toner particles to the negatively charged photoconductive surface is measured by any suitable circuit. Current flow can be measured directly or a proportional voltage level can be measured at the output of the amplifier. It should be understood that any suitable current measuring circuitry can be used and that it is only important to have a measurement that is related to the current flow of the toner particles to the photoconductive surface that, in turn, can be used to adjust the charge on the photoconductive surface.

Figure 3:
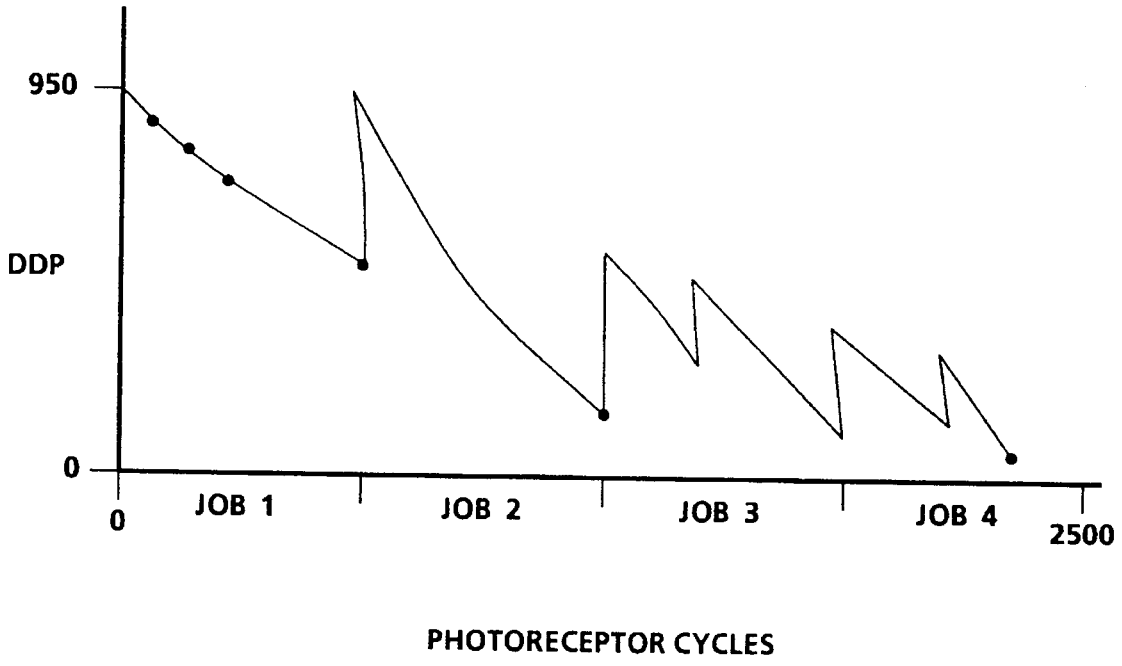
FIG. 3 illustrates typical photoreceptor electrostatic behavior during copy runs at a constant charging voltage.

Various deficiencies exist in the prior art. For example, there is the tendency of a photoreceptor material to degrade and wear over time with the resultant loss of consistency and uniform charge retention ability. This is illustrated in FIG. 3 showing in exaggerated form typical photoreceptor charge retaining properties or dark development potential along the vertical axis as a function of photoreceptor cycles or usage along the horizontal axis. The spike portions of the curve illustrate the ability of the photoreceptor material to recover the charge retention capability after periods of rest after gradual decreases in the charge retention capability during a job run. However, even with rest recovery, the aging tendency is for the photoreceptor to gradually drop from a high DDP to an unacceptable DDP after repeated usage, shown as 2500 cycles.

Another condition in the prior art is the tendency of different segments of the same photoreceptor surface to exhibit different charge retention ability. In particular, discrete areas of the belt are subject to unique environments such as heat from the fuser, trapped ozone, and nitrous oxides which alter the performance of the belt at different rates in different locations. For example, the segment of the photoreceptor normally opposite the fuser station during periodic at rest periods will be affected by heat from the fuser and show a much different voltage retention behavior than other segments of the photoreceptor.

Figure 4:
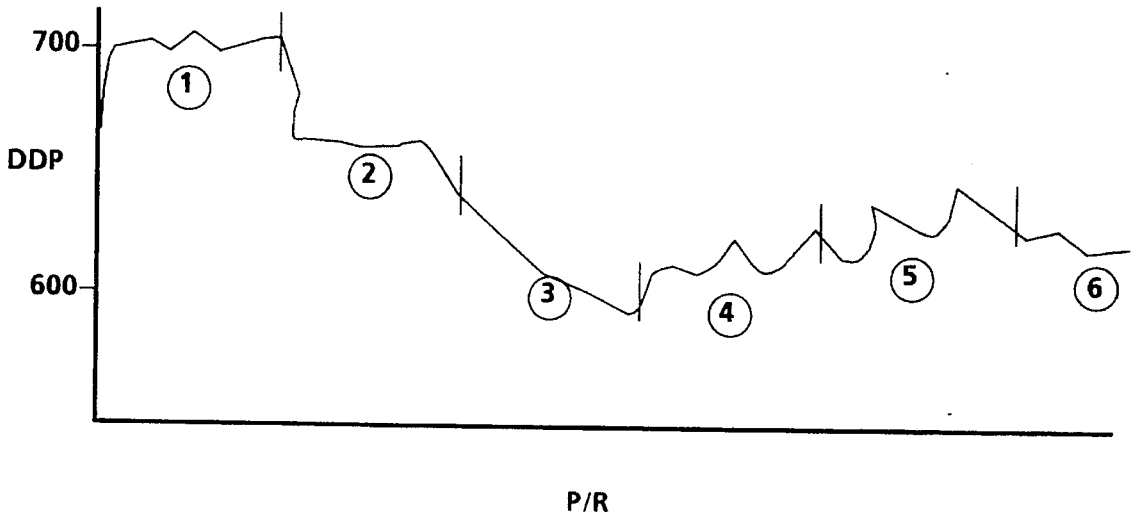
FIG. 4 illustrates a typical voltage profile by segments of an aged photoreceptor.

This is illustrated in FIG. 4 showing the dark development potential of 6 segments of a photoconductive surface. It should be noted that the photoconductive surface could be divided into any arbitrary number of segments for analysis or corrective adjustment. As illustrated, segment 1 with the relatively high potential would typically be the segment normally adjacent the fuser during at rest periods. In general, a toner patch developed on one area of an aged photoconductive surface will differ from other developed patches and will not necessarily predict with accuracy a level of charge needed for the next patch which is in a different location on the photoreceptor belt.

Solutions to some of the above identified problems are disclosed in pending applications, specifically, U.S. Ser. Nos. 192,216 191,976, 191,684, and 192,326 assigned to the same assignee as the present invention. In particular, the sensed current flow providing a measure of the charge on the photoconductive surface is used to adjust the grid voltage of a scorotron to change the voltage level on the photoconductive surface. As shown in FIG. 1, sensor 22 provides a signal to controller 28 connected to high voltage power supply 30. The high voltage power supply 30, in turn, adjusts the voltage on scorotron grid 16 to change the charging voltage on photoconductive surface 12.

Figure 5A:
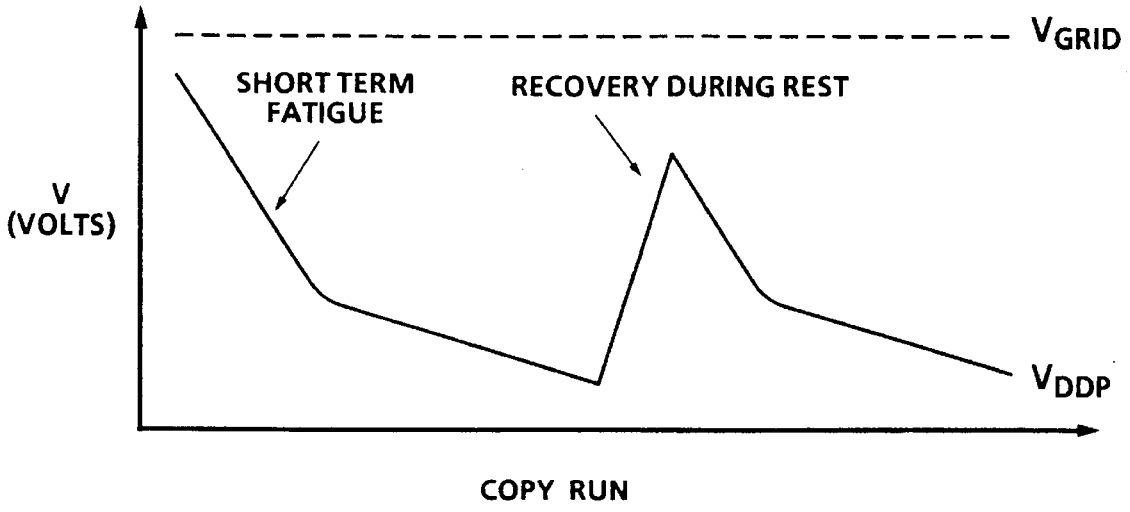
FIG. 5A PRIOR ART
FIGS. 5A and 5B illustrate compensation for typical photoreceptor electrostatic behavior by adjusting charging voltage in accordance with the present invention.

Another feature of the pending applications is a general technique to electrostatically set up the photoconductive surface to proper levels of photoconductive surface charge and to maintain more uniform photoconductive surface voltage characteristics and copy quality during job run using current sensing developability control technology. This is done primarily by suitable adjustment of scorotron grid voltage. With reference to FIG. 5A, there is shown a typical prior art behavior of DDP or dark development potential over time with respect to fatigue and rest recovery of a photoconductive surface with the scorotron grid voltage held constant. As illustrated, short term fatigue and recovery during rest periods significantly affect the level of DDP.

Figure 5B:
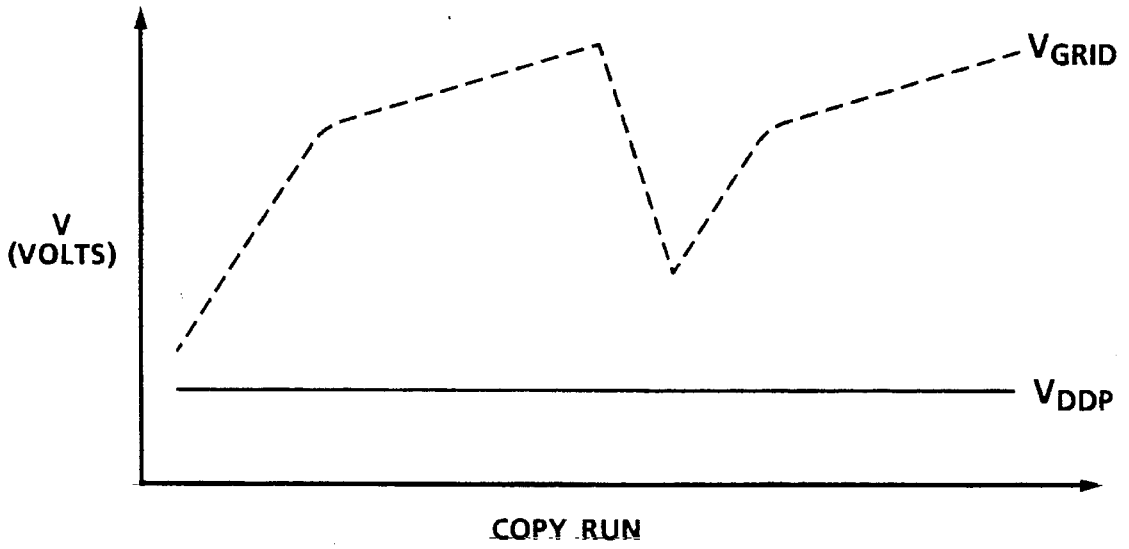

Also, with respect to FIG. 5B, the grid voltage is adjusted to compensate for photoconductive surface fatigue and rest recovery in order to maintain DDP relatively constant. Thus, as the photoconductive surface fatigues, a corrective factor is applied to the grid voltage through the high voltage power supply to level off the DDP voltage. In a similar fashion, for periods of rest recovery, a corrective factor is applied to the grid voltage through the high voltage power supply to again level off the DDP voltage. There is, also, a multi cycle procedure or set of revolutions of the photoconductive surface to accomplish an electrostatic set up (ESU) as shown in the Table below. This set up compensates for the deterioration of a photoreceptor over time and even accounts for discrete photoreceptor segments. Initially, there are five charge/erase cycles to stabilize or condition the photoreceptor before initially setting the scorotron grid voltage.

| Cycle # | Action | Basic Explanation |
|---|---|---|
| 1 | Charge and erase cycle | CSDC zero point is measured to insure the setup can continue. Four charge and erase cycles to move the photoreceptor off the steep portion of the cycle down curve. |
| 2 | Charge and erase cycle | CSDC zero point is measured to insure the setup can continue. Four charge and erase cycles to move the photoreceptor off the steep portion of the cycle down curve. |
| 3 | Charge and erase cycle | CSDC zero point is measured to insure the setup can continue. Four charge and erase cycles to move the photoreceptor off the steep portion of the cycle down curve. |
| 4 | Charge and erase cycle | CSDC zero point is measured to insure the setup can continue. Four charge and erase cycles to move the photoreceptor off the steep portion of the cycle down curve. |
| 5 | Charge and erase cycle | CSDC zero point measured. |

-continued

| Cycle # | Action | Basic Explanation |
|---|---|---|
| 6 | Set scorotron grid voltage | The grid voltage is set at a starting value and a ballpark calculation of grid voltage for DDP is done. |
| 7 | Set scorotron grid voltage | Algorithm hones in on the proper grid voltage (Vg0) for a DDP of −785 volts. |
| 8 | Set scorotron grid voltage | Algorithm hones in on the proper grid voltage (Vg0) for a DDP of −785 volts. |
| 9 | Charge on | Algorithm finishes DDP calculation. Vg0 is determined |
| 10 | Charge and erase cycle | Cycle is used for mathematical calculations. |
| 11 | Grid set at Vg0, erase set at 50% intensity. Bias voltage on | Set the exposure level using CSDC signal from 7 patches and illumination lamp set at 50% intensity. |
| 12 | | Set the exposure level using CSDC signal from 7 patches and illumination lamp set at 50% intensity. |
| 13 | | Set the exposure level using CSDC signal from 7 patches and illumination lamp set at 50% intensity. |
| 14 | | Set the exposure level using CSDC signal from 7 patches and illumination lamp set at 50% intensity. |
| 15 | Exposure set | Lamp intensity is doubled based on exposure multiplier and ABC sensor. |
| 16 | Charge and erase cycle | |
| 17 | Charge and erase cycle | |
| 18 | Charge cycle | Measurement of change in DDP and compared to cycle 9 measurement. Correction value calculated. |
| 19 | Charge, erase off; bias voltage on | Rest recovery time. |
| 20 | Charge cycle | Measure short term rest recovery. |
| 21 | Transfer spiking | Helps eliminate Line on Copy. |

Cycles 1–4: In particular, during the first four cycles the photoreceptor is charged and discharged to fatigue the system to a point which is closer to normal operating voltage of the photoreceptor. This helps reduce the noise and reduces the slope of charge decay of the photoreceptor. For charging, the Vgrid starts at −885 or the initial grid voltage (Vg0) used during the last 2500 cycles. Bias is set at −235 volts, precharge is on and Edge Erase is on. On the first cycle, the CSDC signal is checked to ensure that it is safe to continue running. Failure at this point will cause a given fault indication.

Cycle 5: Calculate CSDC Zero point. During this cycle, the low gain CSDC signal is measured. The CSDC zero point is not a value of zero voltage but the current measured through the CSDC circuit when there is a normal charge and erase cycle with normal bias. Since CSDC signal changes in time and with numerous other variables, the signal is read once every electrostatic set up and every cycle of the photoreceptor during job runs and the zero point reset. Failure at this cycle will cause the display of a suitable fault code. Note that the zero point is constant throughout an ESU once the value is assigned on this cycle.

Cycle 6: Auto range. During cycle six, there is a rough adjustment of the grid voltage of the scorotron to establish a target CSDC signal. This is done with reference to one patch developing on the photoreceptor. The grid voltage starts at −885 volts with the developer bias set to −785 volts. The CSDC signal is measured and if it is in the range 0.8 to 1.2 uA the voltage on the grid is fixed. If the signal is not in that range bias voltage is lowered in steps of 50 volts until the CSDC current is greater than 0.8 microamps. If bias is lowered to −335 volts and the CSDC current is still below 0.8 microamps the grid is placed at a value of −1200 volts. Otherwise, add the amount the bias was dropped from −785 to −885 and put the total value on the grid for the start of set DDP. Precharge erase and Charge are on during this measurement, but edge erase and illumination lamps are off. Failure at this point will result in a fault code, indicating the failure to achieve the target CSDC value.

Cycle 7: Cycle seven is the start of the DDP measurement. Voltage on the grid is fixed at the autorange final value (cycle 6) and the CSDC signal is measured and compared to the actual value of the signal desired. Measurement takes place on six patches with the Vbias on the patches at 685 volts. The CSDC signal is stored in memory for each of the six patches generated.

Cycle 8: Converge on Vgrid reading. This cycle is the same as cycle 7 except the grid values for each of the six patches comes from a calculation based on the grid voltage and CSDC readings for the corresponding patch of cycle 7. In other words, the grid voltage on each patch and the change in CSDC for that patch are calculated as: Vgrid= Vgrid on cycle 7 patch "n"+delta CSDC multiplied by K (where K is a CSDC to voltage conversion factor).

Cycle 9: Cycle nine is the same as cycle 8 with Vgrid calculated as follows: Vgrid (patch n)=Vgrid (patch n) on cycle 8+((delta CSDC from target "n" and delta Vgrid between cycle 7–8)/delta CSDC between cycle 7–8) multiplied by K. At completion, Vgrid becomes Vg0, bias is set to −235 volts. If a failure is detected, a suitable fault code would be given with the grid voltage defaulting to the last good setting or a NVM default.

Cycle 10: Dead cycling. The photoreceptor is dead cycled (charge and discharged) while the processor calculates the Vg0 value based on the voltages seen in cycle 9 (if cycle 9 was successful). Pre-charge erase, charge, and bias are all on during this cycle. However, the illumination lamp comes on late in the cycle to give the lamp time to get up to full intensity for the exposure routine.

Cycle 11–14: Set Exposure routine. During this phase, the exposure lamp voltage is adjusted to obtain a 330 volt potential on the photoreceptor or 50% exposure. All four cycles try to home in on the lamp voltage based on 50% exposure using the six patches available with at least 4 patches being good. Failure to record 330 volts will result in a given fault code.

At the start of cycle 11 the lamp is set at the last exposure point for patches 1, 2 and 3. The starting point for patch 4 comes from patch 1, 5 comes from 3, and 6 comes from 4. After this cycle patch 1 predicts patch one and patch 2 predicts patch 2 etc. On cycle 12 through 14 the patch lamp setting is based on the previous revolutions patch setting and the difference in the CSDC point from target.

Cycle 15: In cycle 15, the charge, erase lamp, exposure lamp, and bias are on. The control algorithm measures the exposure lamp intensity which results from the exposure set on cycle 14 using input from a photodiode, and makes the final background setting by adjusting the lamp output until the desired percentage change in the cycle 14 exposure is achieved (typically 100%). In other words, an exposure multiplier is applied to the reading for 50% exposure to achieve a doubling of intensity or 100% exposure. This setting is stored in memory.

Cycle 16–17: Charge and Discharge Cycles. During these cycles, the photoreceptor is charged and discharged. Vgrid is constant and set at the value calculated in Cycle 9 (Vg0). Pre-charge, charge, exposure and bias are all on during these cycles.

Cycle 18: Auto-correct. This cycle measures the CSDC signal on 5 patches to find the change in photoreceptor potential since Cycle 9, Vgrid is equal to Vg0 and bias is −685 volts. Using the change in potential, fatigue coefficients are calculated. The cycle down voltage is calculated for the run mode and a suitable counter is set.

Cycle 19: Rest Cycle. During this cycle there is no charge or discharge of the photoreceptor and no lights are on.

Cycle 20: Measure DDP and compare. This cycle is to measure the CSDC signal as in cycle 18 to find the change in photoreceptor potential after the one cycle rest (cycle 19) and compare to cycle 18 DDP voltage. The change in the response of the system is called "Delta" and is used in the calculation for corrections to the grid voltage after a short amount of rest time.

Cycle 21: Transfer spiking to clean back of cleaner blade. The transfer corotron is cycled on and off during the entire belt revolution. This is done in attempt to clean the back of the cleaner blade if toner has accumulated during the ESU. If toner is present on the back of the blade and a large fringe field is present from the lead edge of the last copy, it is possible to produce a defect known as 'line on copy' (LOC). Spiking of the transfer to the photoreceptor can pull toner into a non-image area and prevent printout of the LOC defect.

Figure 6:
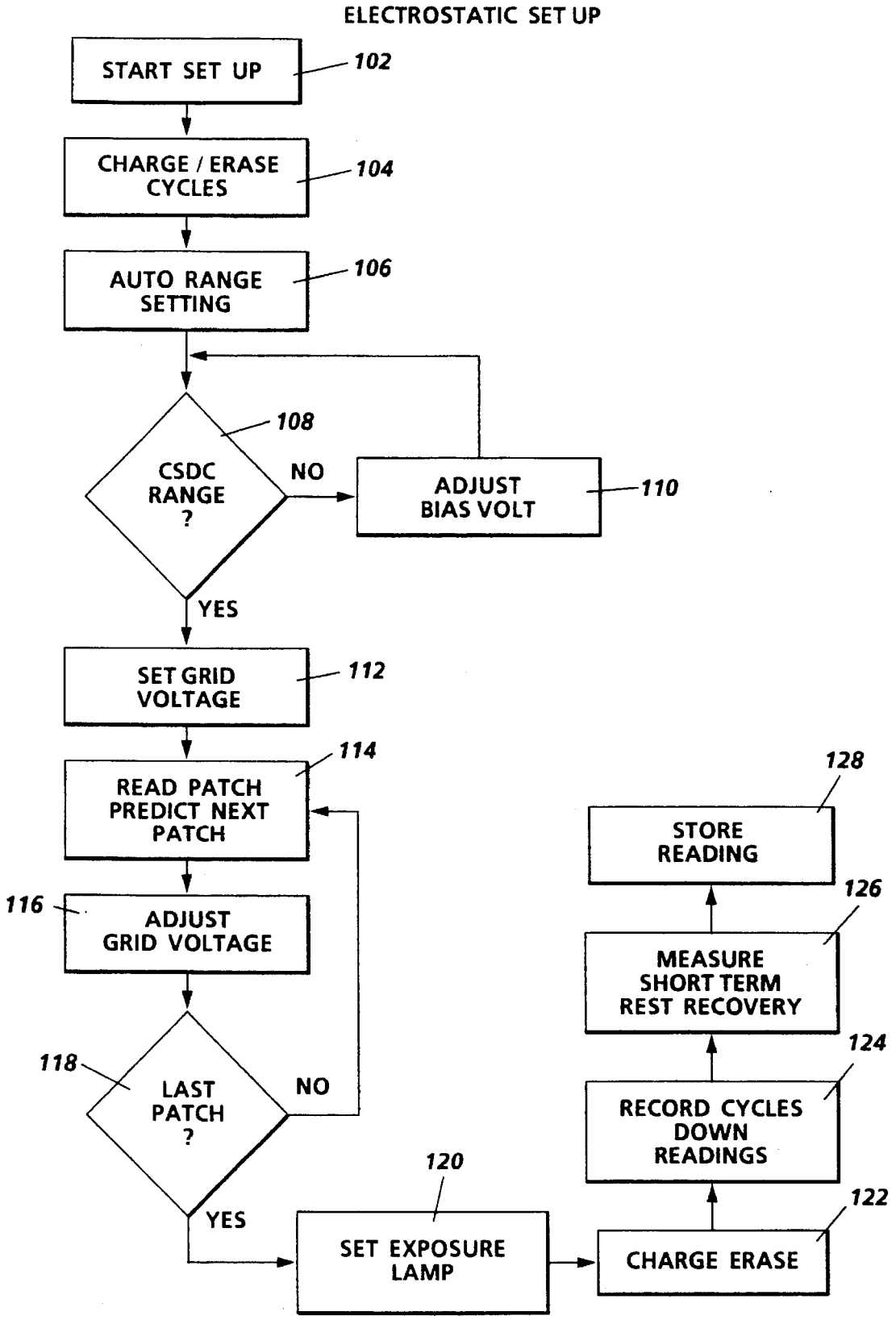
FIG. 6 is a flow chart illustrating an overall procedure for measuring and adjusting photoreceptor characteristics.
Figure 7:
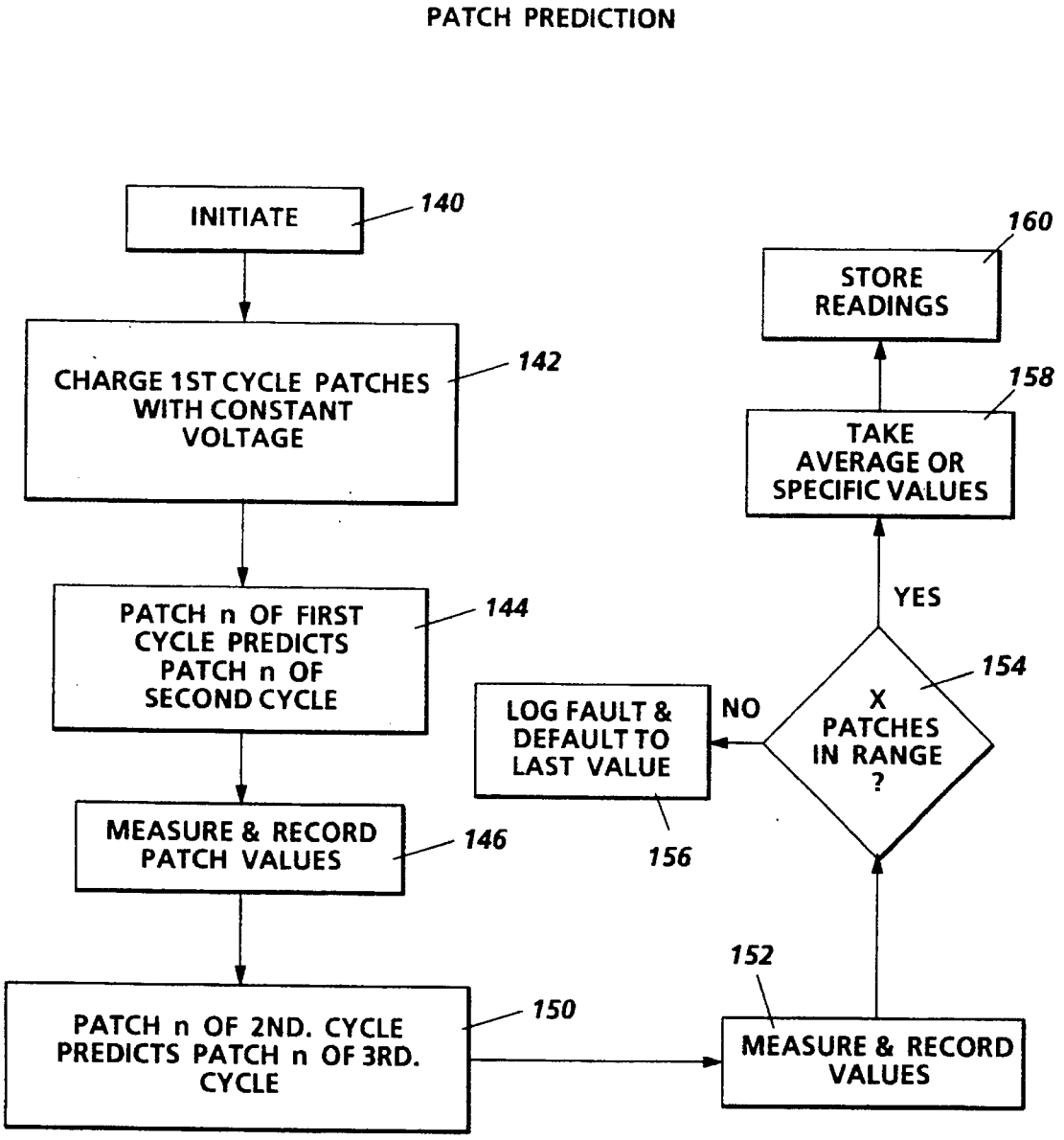
FIG. 7 is a flow chart illustrating a technique for the compensation of non-uniform or discrete segment electrostatic behavior of a photoreceptor.
Figure 8:
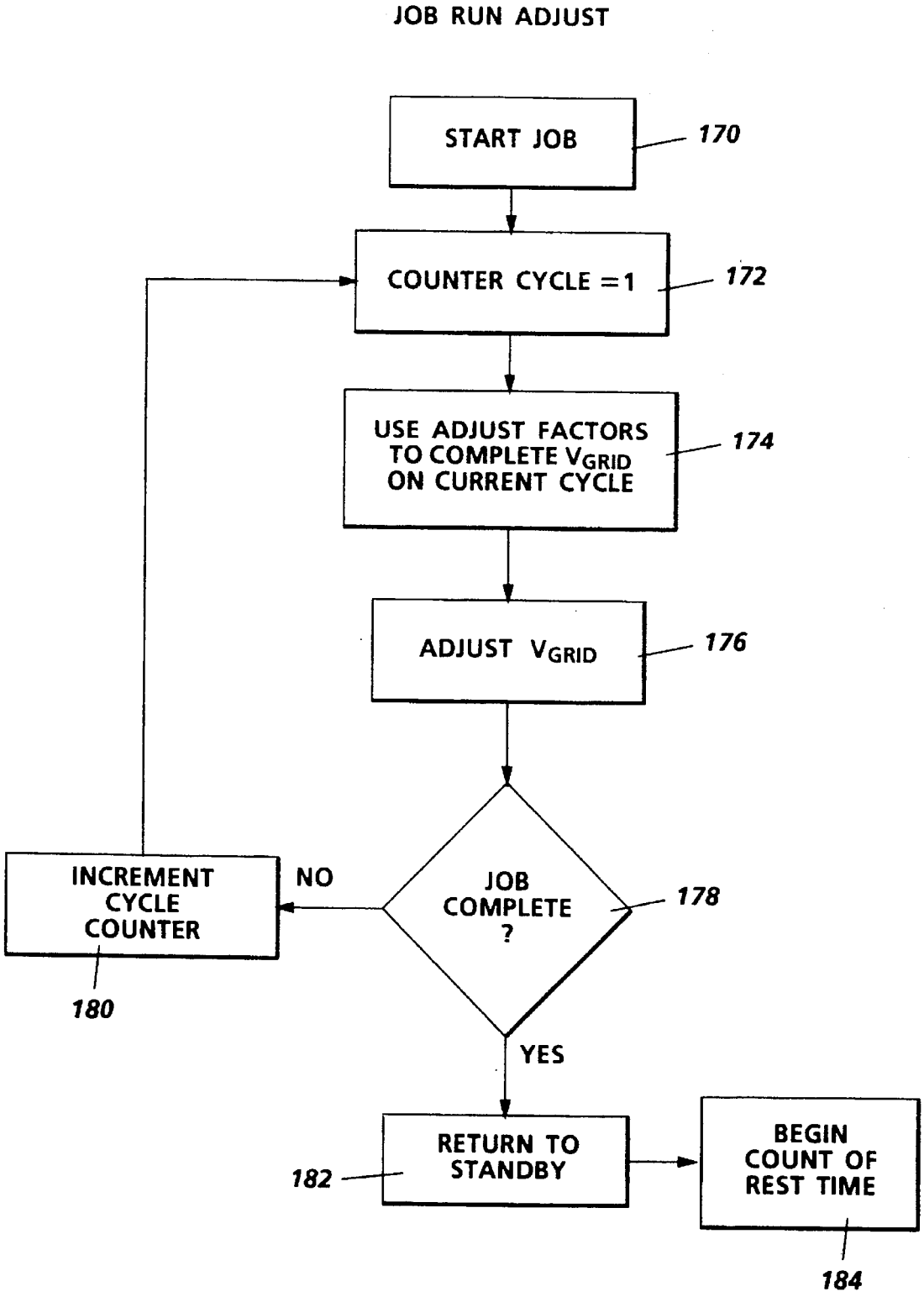
FIG. 8 is a flow chart illustrating a procedure for making job run related corrections to charging grid voltage.

With reference to the FIGS. 6, 7, and 8 flow charts, the above described procedures are further explained. In FIG. 6, there is shown a general photoreceptor electrostatic set up using CSDC technology. After the initial start of the set up shown at block 102, there is a sequence of charge/erase cycles at 104 to condition the photoreceptor. The sequence of charge/erase cycles to condition the photoreceptor is followed by the auto range setting 106 of the grid voltage of the scorotron. This is a sequence of steps to jog the bias voltage on the developer housing until a CSDC signal is measured within a desired range, as shown at 108 and 110. Auto range determines the starting grid voltage, block 112, to develop patches on the photoreceptor for determining the voltage on the photoreceptor and in turn for adjusting the scorotron grid voltage. Thus, blocks 114, 116, and 118 generally illustrate the reading of patches, predicting of grid voltages for subsequent patches, and adjusting grid voltages based upon patch readings.

After the set DDP procedure or after the last patch has been developed and measured for grid voltage adjust, the procedure uses the grid voltage setting to set the exposure lamp voltage as shown at block 120. It should be understood that the various patch readings to adjust the grid voltage include estimating grid voltage to be used for a given patch or patch prediction. One method of patch prediction is illustrated in more detail in FIG. 7. After the setting of the exposure lamp, there is another sequence of charge/erase cycles at block 122 with further readings for photoreceptor DDP cycle down and photoreceptor short term rest recovery at 124 and 126. These readings are stored, block 128, for the job run related adjustments as illustrated in FIG. 8.

With reference to FIG. 7, a typical patch prediction scenario is illustrated. As shown, after initiation at block 140, all patches for the first cycle are charged with a constant grid potential as illustrated at block 142. Next, patch n of a first revolution or cycle predicts patch n of the second revolution or cycle shown at 144 and measured values are stored at block 146. At block 150, patch n of a second revolution predicts patch n of the third revolution and measured values are stored at block 152. In all cases, the grid adjustment or grid values are recorded. Next, there is a decisional step 154 in which according to a predetermined scenario, the values for each patch segment are determined to be or not to be within a given range. In particular, in the general case, if a given number of patches are not within a preferred range, a fault is logged and the system defaults to the last recorded values as shown at block 156. Otherwise, average values or specific values for specific segments can be stored as generally illustrated at 158. As discussed above, in one scenario, a specific value for a segment of the photoreceptor normally at rest near the fuser element is treated separately from the other patch segments. For the other segments, an average value is taken for the initial grip voltage setting. As the final step, as shown at block 160, these readings are stored in suitable memory for future use.

With reference to FIG. 8, there is a job run related adjustment made to grid voltage based upon various factors. After the start of a job shown at block 170, a cycle counter is set at one as illustrated at 172. The grid voltage is determined or computed in the current cycle based upon the various factors such as total belt cycles, cycles per job, rest time of the photoreceptor between job runs, the magnitude of the grid voltage determined through the most recent electrostatic set up, cycle down such as from cycles 9 to 18 during a set up, and rest recovery such as measured between cycles 18 and 20. This information is stored and continually updated in predetermined counters and memory locations in the controller. The grid voltage is adjusted as shown at 176. The cycles of the photoreceptor for the current job are then counted until the job is completed as illustrated at blocks 178 and 180. After the job is complete, the system returns to standby, block 182, and a clock in memory begins to count the photoreceptor rest time, block 184, which will be factored in future adjustments.

Figure 9:
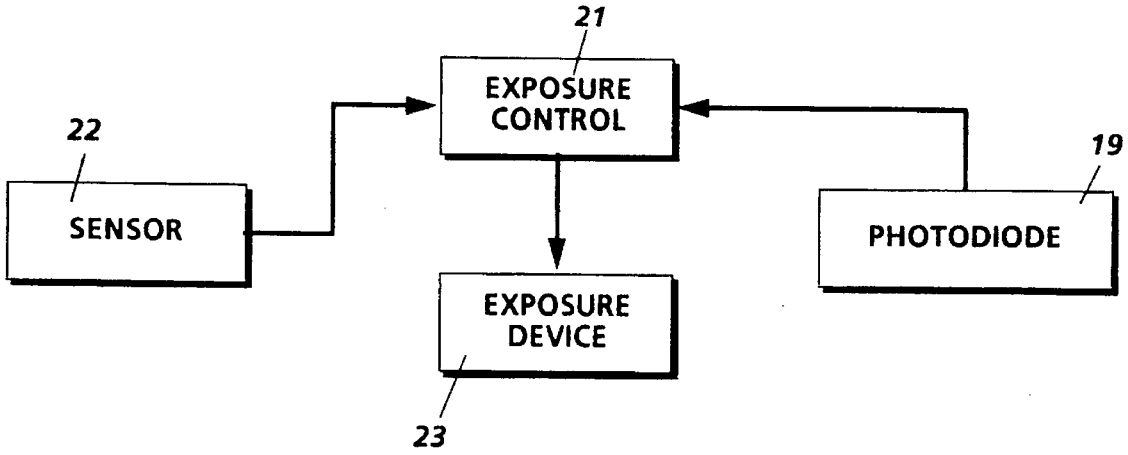
FIG. 9 illustrates two step exposure control in accordance with the present invention.

In accordance with the present invention, with reference to FIGS. 1 and 9, a corona device with a charging grid charges a photoreceptor to voltage levels and an exposure device projects an image onto the photoreceptor. A developer applies toner to the photoreceptor and sensor 22 provides a signal in relation to current flow between the photoreceptor and the developer. An exposure device control 21 adjusts the exposure device 23 by first setting the exposure device to an intensity level of approximately 50%. In one embodiment, 330 volts on the photoreceptor corresponds to approximately 50% reflectance from a white reference patch. This provides a given signal from the photodiode 19 representing 50% reflectance. This signal, preferably, is stored in non-volatile memory and is step 1 in a process for adjusting the exposure device.

For step 1, scorotron 14 with charging electrode and grid 16 is positioned adjacent the photoconductive surface 12 to charge the photoconductive surface to a relatively high uniform potential. The charged portion of photoconductive surface 12 is then rotated to exposure station 18 for discharging the photoreceptor in relation to the charge on the photoreceptor and the intensity level of the exposure lamp. The developer roller 20 advances developer mix into contact with the electrostatic latent image on the photo conductive surface. As toner leaves the developer mag brush and is attracted to the photoreceptor, there is a measurable current flow.

By development of selected toner patches, the amount of voltage on the photoreceptor can be determined. Toner patches can provide various light reflection intensities such as a relatively bare patch representing 100% intensity reflection. A difficulty with many prior art systems, however, is that the systems are not calibrated or sensitive to respond to a 100% reflectance. Therefore, in accordance with the present invention, a 50% reflectance sensor signal is doubled to predict 100% reflectance parameters. The current sensing device including Op Amp 24 provides an output signal at 26 for use by the exposure device control to adjust the exposure device in response to the sensor signal representing an intensity level of approximately 50%.

In step 2, the signal corresponding to 50%reflectance is read from memory. The exposure device control 21 then increases the exposure device 23 output, without the need for any further test patch signals, until the output is approximately double the 50% output. In other words, a signal from the sensor that is double the signal from the sensor at 50% reflectance is assumed to be 100% reflectance. That is, the exposure device control adjusts the exposure device in response to the sensor signals representing an intensity level of approximately 100%. It should be noted that step 2 can be performed periodically to adjust the exposure device without the necessity of repeating step 1. Thus, there is provided a very simple and reliable method of adjusting the exposure device during machine operation. In other words, step 2 can be initiated automatically at predetermined times or events or initiated manually to adjust the exposure device independent of step 1 and a more elaborate system adjustment.

In one embodiment with existing CSDC technology, it should be noted that the lamp is first set to 50% reflectance rather than directly to 100% reflectance because the developer housing bias voltage was fixed. Toner patch development using CSDC requires a minimum development field of approximately 50 volts. Since Bias was fixed (at 235 V), the required development field was obtained at photoreceptor voltages of about 300 volts. This happened to represent the same development field as a 0.3 density input or about 50% reflectance.

With adjustable bias voltage, however, the lamp intensity can be set directly to 100% reflectance using Bias current feedback. It is not mandatory that a correlation between the CSDC (bias) value and a 50% exposure intensity exposure sensor value exist for optical compensation to work. Nor does the CSDC value need to be stored in non volatile memory. The only important values are the exposure (DAC) Digital to Analog Control value and the resulting exposure sensor value. The only reason the exposure DAC value starts at the 50% reflectance point and is then doubled in one embodiment is for ease of software code implementation. For new code, the 100% reflectance value could be used directly. In fact the invention can be independent of CSDC technology in as much as any reasonable process control strategy which can control and set exposure can be used.

In accordance with the present invention, in an image processing apparatus that has a charging device for charging the toner imaging member and an exposure device to optically discharge selected areas of the imaging member or photoreceptor, the output of the exposure device can be automatically set. The exposure device can be set using elements of process control such as toner patch generation and sensor feedback to obtain the required level of discharge of the imaging member for background suppression and image development. Once the required exposure output is obtained, an optical sensor which is located downstream in the optical path and ideally in the same plane as the toner imaging member is used to obtain an output signal corresponding to the set level of exposure. That is, the sensor is located to capture the exposure light after passing through or being reflected from any mirrors or lenses in the optical path. Sensor 19 shown in FIG. 1 illustrates a sensor disposed near the photoconductive surface 12. The exposure set value which typically might be a software DAC value and the signal from the optical sensor corresponding to that value is then stored in memory. At predetermined or given intervals, the optical sensor is used to monitor exposure output and adjustment is made to the exposure set value to compensate for variation in output which normally occurs due to contamination or degradation of the optical system. Furthermore, a comparison between the current exposure sensor value and the original sensor value using the original software DAC value can be used to indicate the need for optical service or cleaning.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In an image processing apparatus having a corona device with a charging grid for charging a photoreceptor to voltage levels, an exposure device for projecting an image onto the photoreceptor, a developer for applying toner to the photoreceptor, a sensor for providing a signal in relation to current flow between the photoreceptor and the developer, and an exposure device control, including a photodiode for sensing light intensity, a method of adjusting the exposure device comprising the steps of;

charging predetermined test patches on the photoreceptor, providing sensor signals to the exposure device control in response to developing the predetermined test patches on the photoreceptor, setting the exposure device to an intensity level of approximately 50% reflection from a given reference providing a first photodiode signal, and storing an indication of the first photodiode signal in memory, and increasing the exposure device intensity level to an intensity level wherein the sensor provides a second photodiode signal approximately double said first photodiode signal.

2. In an image processing apparatus having a corona device with a grid for charging a photoreceptor to given voltage levels, an exposure device including an illumination lamp for projecting an image of an object along an optical path onto the photoreceptor, and a developer for applying charged toner to the photoreceptor, a method for adjusting the exposure device to compensate for exposure device contamination comprising the steps of:

charging a series of predetermined test patches, moving the test patches to the developer and transferring toner from the developer to the test patches at the developer, sensing the movement of charged toner from the developer to the photoreceptor, responsive to the movement of charged toner from the developer to the photoreceptor providing signals, responsive to one of the signals, setting the illumination lamp at a first intensity level, and providing an exposure multiplier to set the illumination lamp at a second intensity level in order to adjust the exposure device to compensate for exposure device contamination.

3. The method of claim 2 including the step of storing an indicator of said one of the signals in non-volatile memory.

4. The method of claim 2 wherein the step of setting the illumination lamp at a first intensity level includes the step of setting the illumination lamp at a level of 50% of full intensity.

5. The method of claim 2 wherein the step of providing an exposure multiplier to set the illumination lamp at a second intensity level includes the step of doubling the first intensity level.

6. In an image processing apparatus having a corona device with a charging grid for charging a photoreceptor to voltage levels, an exposure device for projecting an image onto the photoreceptor, a developer for applying toner to the photoreceptor, a sensor for providing a signal in relation to development, and an exposure device control, a method of adjusting the exposure device comprising the steps of;

setting the exposure device to a first intensity level, providing a first sensor signal corresponding to the first intensity level including the step of measuring the rate of transfer of toner from the developer to the photoreceptor, storing a representation of the first sensor signal in memory, incrementing the first sensor signal to provide a second signal corresponding to a second intensity level, including the step of retrieving the representation of the first sensor signal from memory, and adjusting the exposure device in response to said second signal corresponding to the second intensity level.

7. The method of claim 6 wherein the step of incrementing the first sensor signal includes the step of doubling the first sensor signal.

8. The method of claim 6 wherein the first intensity level is 50% intensity and the second intensity level is 100% intensity.

9. The method of claim 6 including the step of periodically retrieving the representation of the first sensor signal from memory independent of setting the exposure device to the first intensity level.

10. An image processing apparatus having a corona device for charging a photoreceptor, an exposure device for projecting an image of an object along an optical path onto the photoreceptor and providing a first exposure intensity reference signal, a developer for applying toner to the photoreceptor, a sensor for providing a signal in relation to current flow between the photoreceptor and the developer as a result of the developer applying toner to the photoreceptor, the corona device including a grid and said corona device responding to the signal of the sensor for adjusting the grid for charging the photoreceptor, the sensor providing a first signal corresponding to a partial reflectance from a partial reflectance reference patch, and an exposure device control responsive to said first exposure intensity reference signal for adjusting the exposure device for maximum exposure intensity.

11. The processing apparatus of claim 10 wherein the exposure device is set to obtain a predetermined voltage on the photoreceptor corresponding to approximately 50% exposure intensity.

12. The processing apparatus of claim 11 wherein the voltage on the photoreceptor corresponding to approximately 50% exposure intensity is approximately 300 volts.

13. The processing apparatus of claim 10 wherein the exposure device control includes means to increase the exposure device output until the sensor provides a second signal corresponding to approximately 100% exposure intensity.

14. The processing apparatus of claim 13 wherein the sensor measures current flow in the range of 0–10 microamps.

15. The processing apparatus of claim 13 wherein the sensor includes an amplifier for converting current range into voltage in the range of 0–10 volts.

16. An image processing apparatus having a charging device for charging an imaging member, an optic system having an exposure device to discharge selected portions of the imaging member in an interference relationship with an optical path, an element for automatically setting the exposure device to obtain a suitable level of discharge of the imaging member for image development, and an optical sensor in the optical path, the optical sensor providing a signal corresponding to a set level of exposure, the optical sensor monitoring exposure levels at given intervals to adjust the set level of exposure in order to compensate for degradation of the optical system.

17. The apparatus of claim 16 wherein the optical sensor is in the same plane as the imaging member.

18. The apparatus of claim 16 including a photoreceptor and wherein the optical system is located near the photoreceptor.

19. The apparatus of claim 16 wherein an indication of the set level of exposure is stored in memory.

20. In an image processing apparatus having a corona device with a charging grid for charging a photoreceptor to voltage levels, an exposure device for projecting an image onto the photoreceptor, a developer for applying toner to the photoreceptor, a sensor for providing a signal in relation to development, and an exposure device control, a method of adjusting the exposure device comprising the steps of;

setting the exposure device to a first intensity level, providing a first sensor signal corresponding to the first intensity level including the step of measuring the rate of transfer of toner from the developer to the photoreceptor, storing a representation of the first sensor signal in memory, incrementing the first sensor signal to provide a second signal corresponding to a second intensity level, including the step of retrieving the representation of the first sensor signal from memory, and adjusting the exposure device in response to said second signal corresponding to the second intensity level.

21. The method of claim 20 including the step of periodically retrieving the representation of the first sensor signal from memory independent of setting the exposure device to the first intensity level.

22. The method of claim 20 wherein the step of providing the first sensor signal includes the step of measuring the rate of transfer of toner from the developer to the photoreceptor.

* * * * *